US005737387A

United States Patent [19]

Smither

[11] Patent Number: 5,737,387

[45] Date of Patent: Apr. 7, 1998

[54] COOLING FOR A ROTATING ANODE X-RAY TUBE

[75] Inventor: Robert K. Smither, Hinsdale, Ill.

[73] Assignee: ARCH Development Corporation, Chicago, Ill.

[21] Appl. No.: 212,180

[22] Filed: Mar. 11, 1994

[51] Int. Cl.[6] ..... H01J 35/10

[52] U.S. Cl. ..... 378/130; 378/131; 378/132

[58] Field of Search ..... 378/130, 141, 378/199, 200, 202, 131, 132

[56] References Cited

U.S. PATENT DOCUMENTS

| | | | |
|---|---|---|---|
| 2,748,356 | 5/1956 | Kaehni . | |
| 3,270,250 | 8/1966 | Davis . | |
| 3,287,677 | 11/1966 | Mohr . | |
| 3,327,776 | 6/1967 | Butt . | |
| 3,348,487 | 10/1967 | Miller . | |
| 3,377,523 | 4/1968 | Andersson et al. . | |
| 3,405,323 | 10/1968 | Surty et al. . | |
| 3,411,041 | 11/1968 | Block . | |
| 3,412,462 | 11/1968 | Stutzman . | |
| 3,417,575 | 12/1968 | Stark . | |
| 3,481,393 | 12/1969 | Chu . | |
| 3,526,798 | 9/1970 | Sandstrom . | |
| 3,546,511 | 12/1970 | Shimula . | |
| 3,694,685 | 9/1972 | Houston | 378/130 |
| 3,719,847 | 3/1973 | Webster | 313/60 |
| 3,812,404 | 5/1974 | Barkan et al. | 371/234 R |
| 3,914,633 | 10/1975 | Diemer et al. | 313/32 |
| 4,037,270 | 7/1977 | Ahmann et al. | 361/385 |
| 4,130,772 | 12/1978 | Küssel et al. | 313/32 |
| 4,130,773 | 12/1978 | Küssel | 313/32 |
| 4,165,472 | 8/1979 | Wittry | 316/35 |
| 4,210,371 | 7/1980 | Gerkema et al. | 308/9 |
| 4,264,818 | 4/1981 | Petersen | 250/420 |

(List continued on next page.)

FOREIGN PATENT DOCUMENTS

| | | |
|---|---|---|
| 527005 | 1/1977 | Japan . |
| 913527 | 7/1980 | U.S.S.R. . |

OTHER PUBLICATIONS

Smither, Robert K., "Use of Liquid Metals as Cooling Fluids", presented Aug. 3–5, 1989 at a workshop at Argonne National Laboratory.

Smither, et al., "Liquid Gallium Cooling of Silicon Crystals in High Intensity Photon Beams (Invited)", *Rev. Sci, Instrum.* 60(7), Jul. 1989, pp. 1486–1492.

Tuckerman et al., "High Performance Heat Sinking for VLSI", *IEEE Electron Device Letters,* vol. EDL–2, No. 5, May 1981, pp. 126–129.

Smither et al., "Liquid Gallium Metal Cooling for Optical Elements with High Loads", Argonne National Laboratory, Nov. 1987.

Chu, Richard C., "Heat Transfer in Electronics Systems", International Business Machines Corporation pp. pp. 293–305.

Allovskii et al. "Calculation of a Minimum Weight Cylindrical–Helical DC Induction Pump", *Magnitnaya Gidrodinamika,* vol. 2, No. 1, Sep. 1964, pp. 69–72.

Davidson et al. "Sodium Electrotechnology at the Risley Nuclear Power Development Laboratories", *Nucl. Energy,* vol. 20, No. 1, Feb. 1981, pp. 79–90.

Muijderman et al., "Diagnostic X–Ray Tube with Spiral–Groove Bearings", *Philips Research Topics,* Nov. 1989, pp. 1–7.

Rare Earth Magnet Advertisment, Thomas Register 1992, p. 16579.

*Primary Examiner*—Don Wong
*Attorney, Agent, or Firm*—Michael D. Rechtin

[57] ABSTRACT

A method and apparatus for cooling a rotating anode X-ray tube. An electromagnetic motor is provided to rotate an X-ray anode with cooling passages in the anode. These cooling passages are coupled to a cooling structure located adjacent the electromagnetic motor. A liquid metal fills the passages of the cooling structure and electrical power is provided to the motor to rotate the anode and generate a rotating magnetic field which moves the liquid metal through the cooling passages and cooling structure.

9 Claims, 5 Drawing Sheets

U.S. PATENT DOCUMENTS

| | | | |
|---|---|---|---|
| 4,268,850 | 5/1981 | Lazarek et al. | 357/82 |
| 4,327,399 | 4/1982 | Sasaki et al. | 361/385 |
| 4,369,517 | 1/1983 | Ozawa | 378/130 |
| 4,374,457 | 2/1983 | Wiech, JR. | 29/591 |
| 4,405,876 | 9/1983 | Iversen | 378/130 |
| 4,455,504 | 6/1984 | Iversen | 378/130 |
| 4,510,347 | 4/1985 | Wiech, Jr. | 174/68.5 |
| 4,519,447 | 5/1985 | Wiech, Jr. . | |
| 4,519,877 | 5/1985 | Wiech, Jr. | 204/15 |
| 4,531,145 | 7/1985 | Wiech, Jr. | 357/82 |
| 4,557,667 | 12/1985 | Delassus et al. | 417/50 |
| 4,562,092 | 12/1985 | Wiech, Jr. | 427/58 |
| 4,614,445 | 9/1986 | Gerkema et al. | 384/368 |
| 4,622,687 | 11/1986 | Whitaker et al. | 378/130 |
| 4,641,332 | 2/1987 | Gerkema | 378/125 |
| 4,773,826 | 9/1988 | Mole | 417/50 |
| 4,775,298 | 10/1988 | Lauhoff et al. | 417/50 |
| 4,776,767 | 10/1988 | Motomura | 417/50 |
| 4,802,531 | 2/1989 | Nathenson et al. | 165/104.28 |
| 4,808,079 | 2/1989 | Crowley et al. | 417/50 |
| 4,808,080 | 2/1989 | Alexion et al. | 417/50 |
| 4,818,185 | 4/1989 | Alexeff | 417/50 |
| 4,824,329 | 4/1989 | Yamamoto et al. | 417/50 |
| 4,828,459 | 5/1989 | Behrens | 417/50 |
| 4,828,460 | 5/1989 | Saito et al. | 417/50 |
| 4,842,170 | 6/1989 | Del Vecchio et al. | 222/590 |
| 4,856,039 | 8/1989 | Roelandse et al. | 378/133 |
| 4,866,517 | 9/1989 | Mochizuki et al. | 378/119 |
| 4,928,933 | 5/1990 | Motomura | 266/237 |
| 5,077,775 | 12/1991 | Vetter | 378/133 |
| 5,077,776 | 12/1991 | Vetter | 378/133 |
| 5,209,646 | 5/1993 | Smither | 417/50 |
| 5,541,975 | 7/1996 | Anderson et al. | 378/130 |

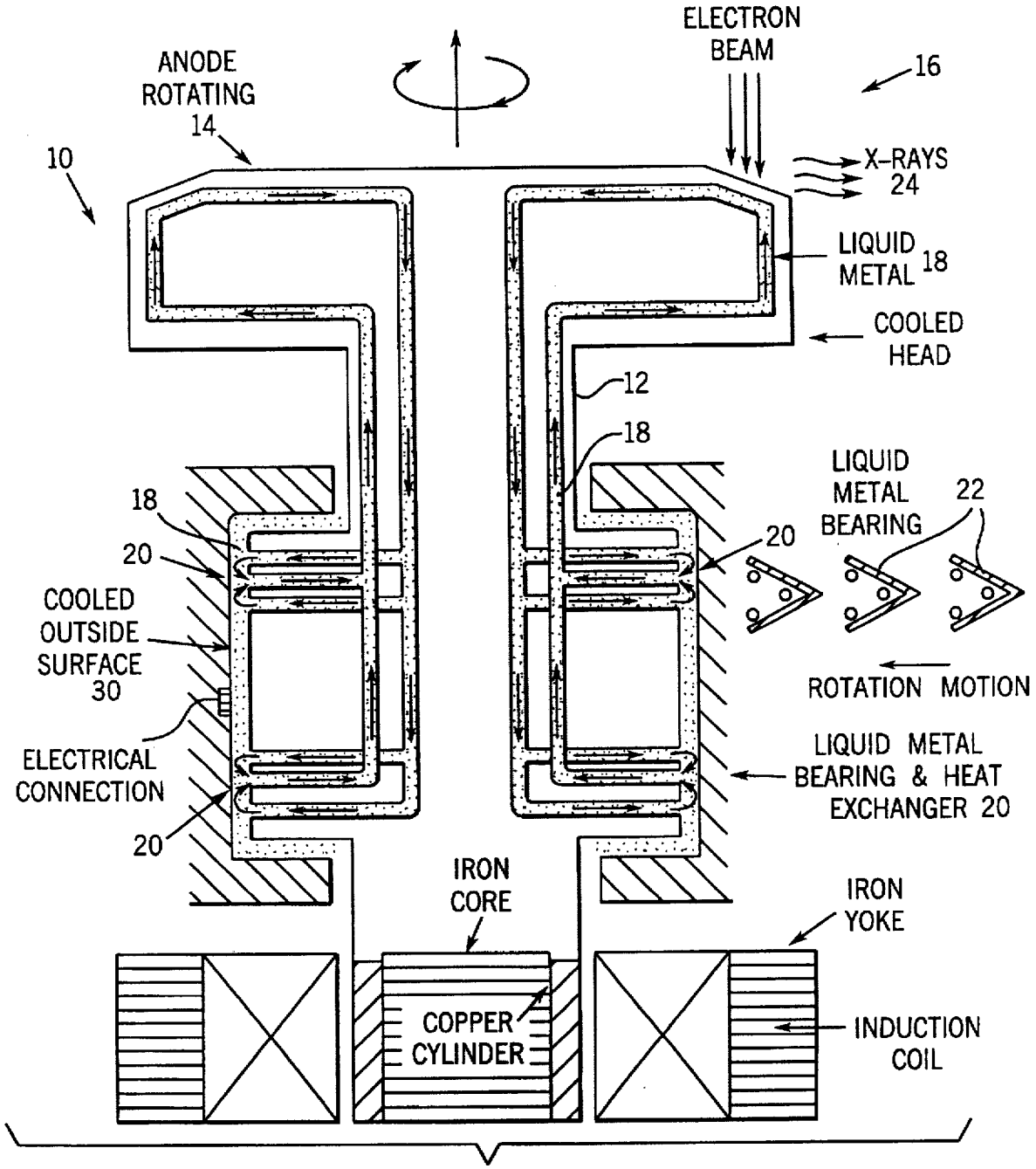
FIG. 1A
FIG. 1B
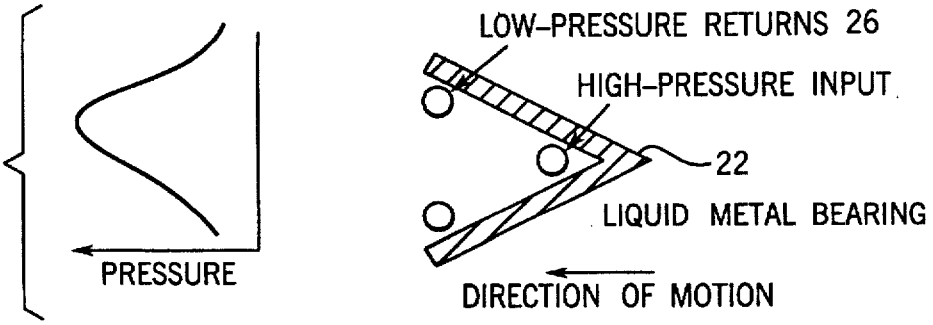

COOLING FOR A ROTATING ANODE X-RAY TUBE

BACKGROUND OF THE INVENTION

The present invention generally relates to a system for removing heat from the external working surfaces of a rotating device using liquid flow through passages within the rotating structure. More particularly, the present invention relates to a cooling system for removing heat from working surfaces of a rotating anode of a high intensity x-ray tube.

The ability to increase power levels and operating duration in rotating anodes of high intensity x-ray tubes is important because these devices can be used to carry out various preliminary tests in the design and operation of new experimental equipment to be used with advanced synchrotrons. In addition, these devices have medical applications where there are problems of downtime caused by excessive heat buildup resulting from limited cooling.

A high intensity x-ray anode can transfer heat through radiation from its hot surface or from conduction of the heat to a suitable heat exchanger. Until recently, conventional rotating anodes in high intensity x-ray tubes have only been able to transfer most of their heating through radiation. While radiative cooling transfers heat quickly when the anode is extremely hot, the rate of heat transfer drops quickly as the anode cools to temperature levels which are still too high for efficient operation.

The heat conductivity through the rotating bearings (usually ball bearings) of conventional anodes has typically been undesirably low. Liquid metal bearings have made it possible to extract some heat through conduction of heat through this new liquid bearing. This has resulted in improvements in performance both in continuous operation and in pulsed operation x-ray applications. However, more substantial performance improvements in these applications are provided by the greatly increased heat transfer characteristics of the present invention.

The present invention further improves the heat transfer from the rotating anode to the ambient outside surrounds. One preferred method and apparatus introduces a liquid metal cooling loop in the anode that carries the heat away from the anode surface that is absorbing power from an electron beam that produces the x-rays. This heat is delivered to a rotating metal seal-bearing where it is conducted to an outside heat exchanger. These improvements in cooling the working surfaces of the rotating anodes can provide substantially improved performance. While references have disclosed the use of spiral-groove bearings with liquid metal as the lubricant, cooling limitations of these spiral-groove bearing rotating anode designs have continued to limit performance.

In one form of the present invention, a rotating anode is provided with coolant flow passages (generally in the form of a loop) which extend from adjacent the working or high heat load surfaces of the anode to near or at the liquid bearing. Circulation of the coolant results in removal of heat from the working surfaces of the anode to regions where external heat transfer is more feasible. In one preferred embodiment, a separate pump in the rotating anode provides the pressure for the circulation, with the heat load being transferred to a heat exchanger adjacent the pump and liquid bearing. In another preferred embodiment, shaped extensions on the rotating anode extend into the liquid of the bearings and act to generate pressure for the pumping. The coolant loop for the anode is coupled to the liquid bearing.

In yet another preferred embodiment, the stationary section of the anode is a central support within the rotating anode and serves to dissipate the heat transferred through the liquid bearing. In another preferred embodiment, pressure causing the flow of coolant is generated by the use of a magnetic field and current oriented to generate the required force. This embodiment also includes a modification to incorporate the pump in the induction motor used to rotate the anode.

While the invention has been primarily directed to a rotating anode, it should be noted that the invention would also apply to other rotating devices which would benefit from more efficient transfer of heat from working surfaces at high temperatures across a liquid bearing or to another region where external heat transfer is more feasible. As noted hereinbefore, prior art designs have not provided satisfactory cooling for these applications.

It is therefore an object of the invention to provide an improved cooling system and method of use for a rotating anode x-ray tube.

It is a further object of the invention to provide a novel method and apparatus for improving heat transfer from a rotating anode to other structures using a liquid metal coolant.

It is another object of the invention to provide an improved method and apparatus for cooling a rotating anode x-ray tube using a liquid metal cooling loop in the anode.

It is a still further object of the invention to provide a novel method and apparatus for circulating liquid metal coolant in a rotating anode x-ray tube using magnetic fields to produce forces to cause the liquid metal coolant to flow through a cooling system.

It is yet another object of the invention to provide an improved method and apparatus for cooling a rotating anode x-ray tube using an induction motor both to rotate the anode and to pump liquid metal coolant through a cooling loop for the rotating anode.

It is a still further object of the invention to provide a novel method and apparatus for using spiral-groove bearings to pump liquid metal coolant through a cooling system.

Other advantages and features of the invention, together with the organization and the manner of operation thereof, will become apparent from the following detailed description when taken in conjunction with the accompanying drawings, wherein like elements have like numerals throughout the drawings.

BRIEF DESCRIPTION OF THE DRAWINGS

FIG. 1A illustrates a rotating anode cooled by liquid metal pumped by a liquid metal spiral groove bearing, and FIG. 1B illustrates a pressure curve corresponding to a liquid metal bearing of the present invention;

DETAILED DESCRIPTION OF PREFERRED EMBODIMENTS

Figure 2:
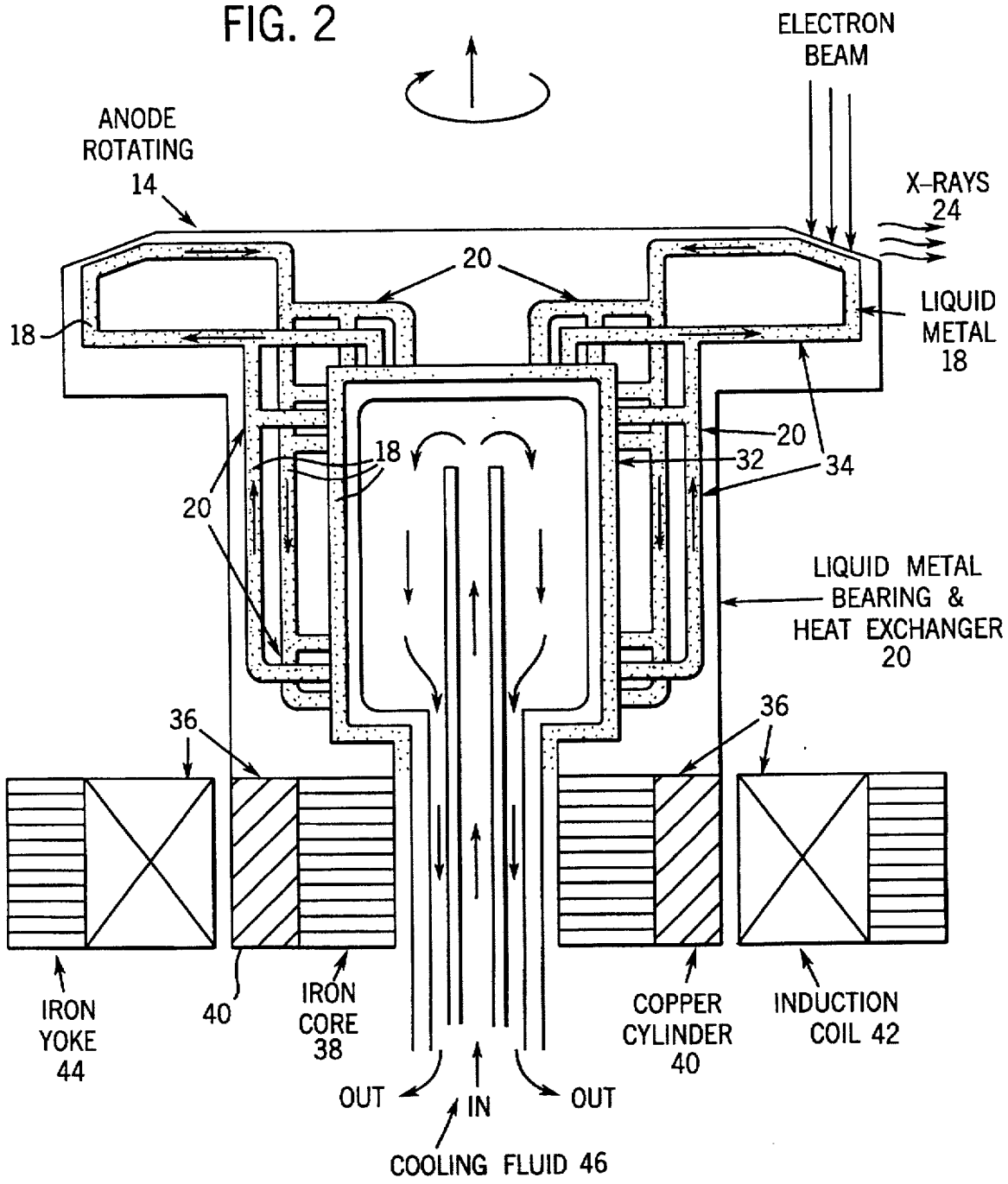
FIG. 2 shows a rotating anode including a liquid metal bearing and an internal heat exchanger.

Referring to the figures and more particularly to FIG. 1, a cooling system constructed in accordance with the invention is indicated at 10. A first preferred embodiment of the invention thermally couples a stem 12 of a rotating anode 14 to the outside 16 through a layer of liquid metal 18 that is both the rotating bearing 20 for the rotating anode 14 and the path for the flow of heat. While various liquid metals can be used, gallium is preferred because it flows readily and does not vaporize during the cooling operations of the present invention. This embodiment uses the pressure built up in the center of "V" grooves 22 in spiral-groove rotating bearings 20 to pump gallium through the system. Because conventional spiral-groove bearings are well-known in the art, only the modified "V" grooves 22 are shown. The liquid metal 18 removes heat from the rotating anode 14 area where x-rays 24 are generated and transports it back to the liquid metal spiral groove rotating bearing 20 where it enters the bearing area through low pressure returns 26 (shown in FIG. 1B) located near the outside of the rotating bearing 20 (where the pressure is low relative to the center of the V-groove 22). As the liquid metal 18 flows from the outside of the bearing area inward to the high pressure input 28 near the center of the V-groove 22, the liquid metal 18 contacts the outside surface 30 of the liquid rotating bearing 20 which is cooled. This carries the heat away from the liquid rotating bearing 20 and keeps the rotating anode 14 cool.

Most prior art rotating anodes use ball bearings to support the rotating anode. Very little heat is transferred through these bearings. Thus, most of the cooling is radiative cooling which is effective only when the anode is very hot. As the anode cools, the radiative cooling decreases rapidly. Thus, a long time is needed to cool the tube enough to begin operation again. Using thermal conductivity through the stem 12 of the rotating anode 14 and the thermal conductivity of the liquid metal 18 interface to remove the heat decreases the waiting time between exposures in medical x-ray applications. Further, circulating the liquid metal 18 adjacent the surface of the rotating anode 14 removes the heat faster and shortens the waiting time by another factor of two.

While FIG. 1A shows a configuration where the rotating anode 14 structure is inside a cooled outside structure, FIG. 2 illustrates a configuration where the rotating anode 14 structure surrounds a stationary cooled structure 32. The circulation of the liquid metal 18 and the action of the pump-liquid-bearing are quite similar in both cases, but the second system constructed in accordance with the invention (FIG. 2) can be made more compact and the cooling channels 34 can be made shorter.

Two additional liquid metal rotating bearings 20 are shown in FIG. 2, at the top of the cooled structure 32. These are desired along with a second pair at the bottom of the cooled surface (not shown) to restrict the movement of the rotating anode 14 in the vertical direction. In both configurations (shown in FIGS. 1A and 2), the rotating anode 14 is driven by an AC induction motor 36 mounted at the bottom of the assembly. This induction motor 36 is shown in an abbreviated form for these embodiments. Details not shown are well-known to those skilled in the art.

The part of the induction motor 36 that is attached to the rotating anode is shown as an iron core 38 surrounded by a copper cylinder 40. Conventionally, the iron core 38 will have a copper or aluminum bird cage embedded in it and the induction coil 42 will be incorporated in an iron yoke 44 to enhance the magnetic field.

The induction coil 42 generates a horizontal magnetic field that rotates and induces currents in the copper cylinder 40 (or bird cage) that interacts with the magnetic field and generates the force needed to rotate the anode 14. Cooling fluid 46 that cools the stationary cooled structure 32 and thus cools the liquid metal 18 can be a non-conducting fluid such as water or oil, so the rotating anode 14 can be operated at a high voltage relative to ground. With high voltage x-ray tubes, it is common for one half the voltage across the tube to be applied to the cathode and one half the voltage difference to be applied to the rotating anode 14. An alternating current induction motor 36 is used to rotate the rotating anode 14 because it does not require any electrical contact between the rotor (anode 14) and the driving mechanism (induction motor 36). The vacuum enclosure needed around the rotating anode 14 is well known to those skilled in the art and is not shown in FIG. 1 or in any of the other figures. In the configuration shown in FIG. 1, the interface of the liquid metal 18 between the rotating anode 14 and the stationary cooled structure can be used as a vacuum seal as well.

Figure 3:
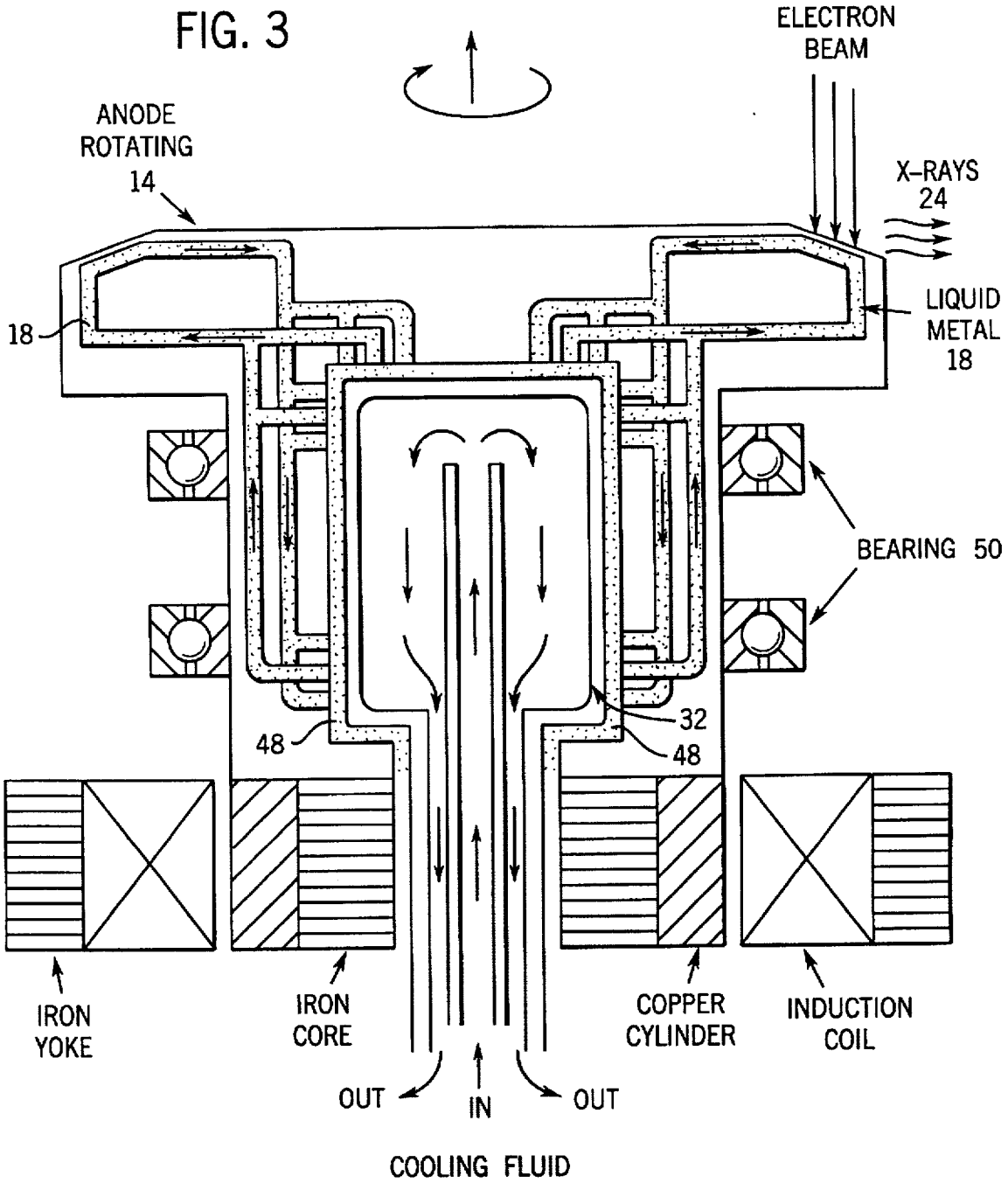
FIG. 3 illustrates a rotating anode including a conventional bearing.

A second preferred embodiment uses a system similar to the one shown in FIG. 1 and FIG. 2. This system is modified such that the liquid metal 18 in the space between the rotating anode 14 and the cooled stationary structure 32 is not used as a rotating bearing 20, but just as a pump and as heat transfer medium to conduct heat from the rotating anode 14 to the cooled stationary structure 32 (see FIG. 3). Conventional mechanical bearings 50 mount the rotating anode 14 for rotation in this embodiment. The bearings are now cooled by the liquid metal 18 after it has been cooled in the gap 48 between the rotating anode 14 and the cooled stationary structure 32. By not using the liquid metal 18 as a liquid metal bearing, the gap parameters can be varied to enhance the pumping action and the removal of heat without being limited by the requirements of a liquid metal bearing. Thus, increases in speed of rotation of the rotating anode 14 and increases in the pumping action are possible.

Figure 4:
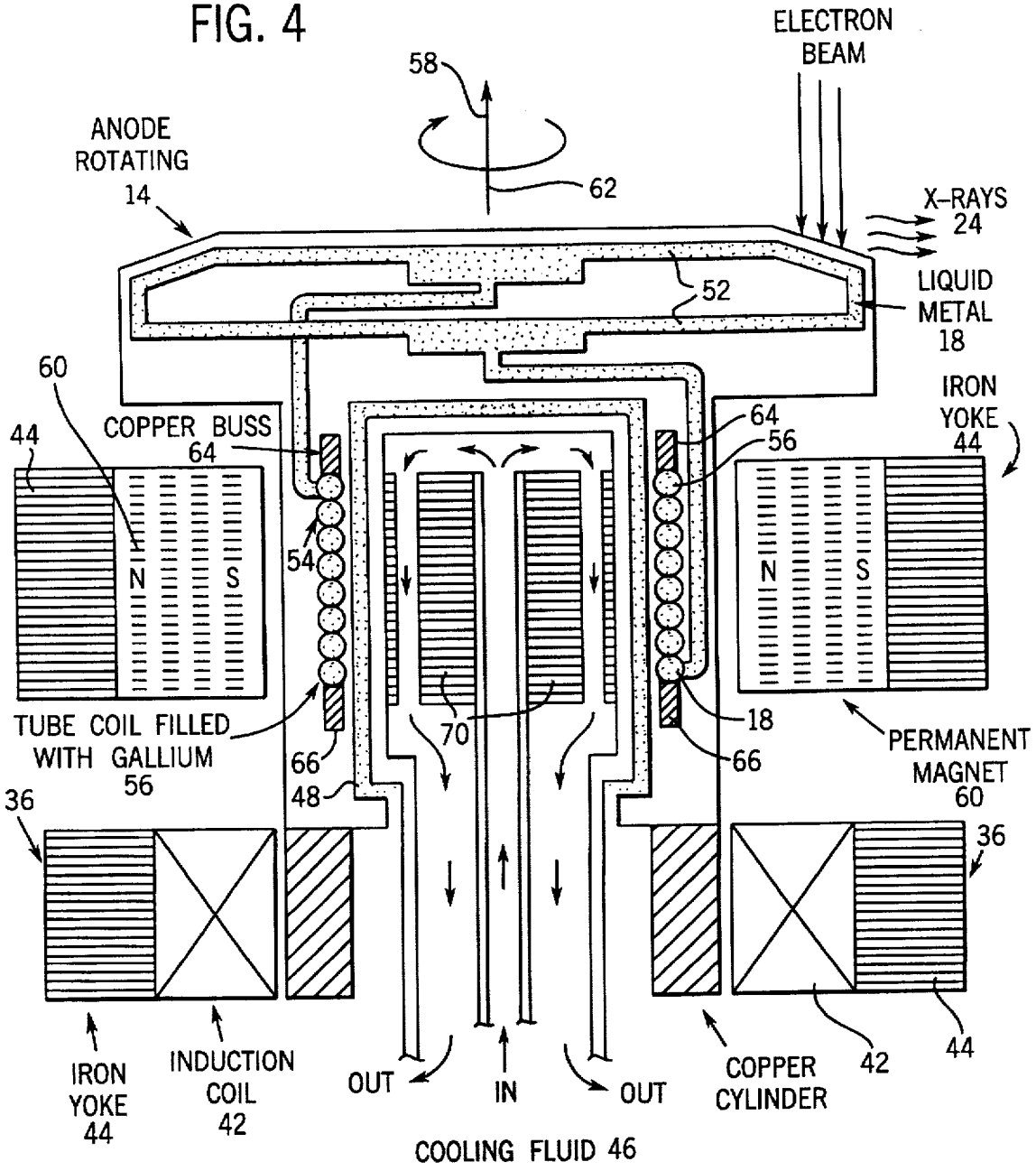
FIG. 4 shows a rotating anode including a rotating magnet structure to pump liquid metal coolant.

A third preferred embodiment requires the structure for the rotating anode 14 which is shown in FIG. 4. In this embodiment of the invention, an induction motor 36 pumps the liquid metal 18 through channels 52 just below the surface of the rotating anode 14 where the x-rays 24 are generated and returns it to channels 52 adjacent to the liquid metal 18 cooled surface of the rotating anode 14. A pump 54 comprises a hollow tube coil 56 mounted in the rotating anode 14 structure with the axis 58 of the coil 56 being parallel to the axis of rotation 62. The coil 56 is filled with liquid metal 18 (preferably gallium) and is connected to the channels 52 that cool the hot surfaces of the rotating anode 14. While various durable materials can be used, the tube coil 56 preferably comprises stainless steel tubing.

A permanent magnetic field that is generated by permanent magnets 60 passes through the rotating tube coil 56 on one side, then through the center core of magnet iron and out through the tube coil 56 on the other side and is returned to the starting magnet by an iron yoke 44. As the rotating anode 14 rotates, the magnetic field induces an electromotive force directed up one side of the tube coil 56 and down the opposite side of the tube coil 56. This electromotive force generates a direct current that travels up one side of the tube coil 56, passing through the liquid metal 18 in the tube coil 56. Each coil 56 is soldered to the adjacent coil 56 and makes good electrical contact with the coil 56 above it and below it. The liquid metal 18 then flows across the top of the tube coil 56 in a copper ring 64 soldered to the top of the tube coil 56 and down the other side of the tube coil 56, again, passing through the liquid metal 18 and back across the bottom of the tube coil 56 in a second copper ring 66 soldered to the bottom of the tube coil.

The current in the tube coil 56 interacts with the magnetic field generated by the permanent magnets 60 to generate a force on the liquid metal 18 that drives it in the direction of the tube 56 and causes the liquid metal 18 (preferably gallium) to flow in the cooling channels 52, cooling the hot surfaces of the rotating anode 14.

This approach uses an induction motor 36, mounted at the bottom of the rotating anode 14, to rotate the system. The faster that the anode 14 is rotated, the more pumping action of the liquid metal 18 that is generated. As mentioned above, the force needed to rotate the anode 14 is produced by the induction motor 36 mounted at the bottom of the rotating anode 14. The conventional bearings (not shown) that guide the rotating anode can also be cooled by the liquid metal 18 flow.

Figure 5:
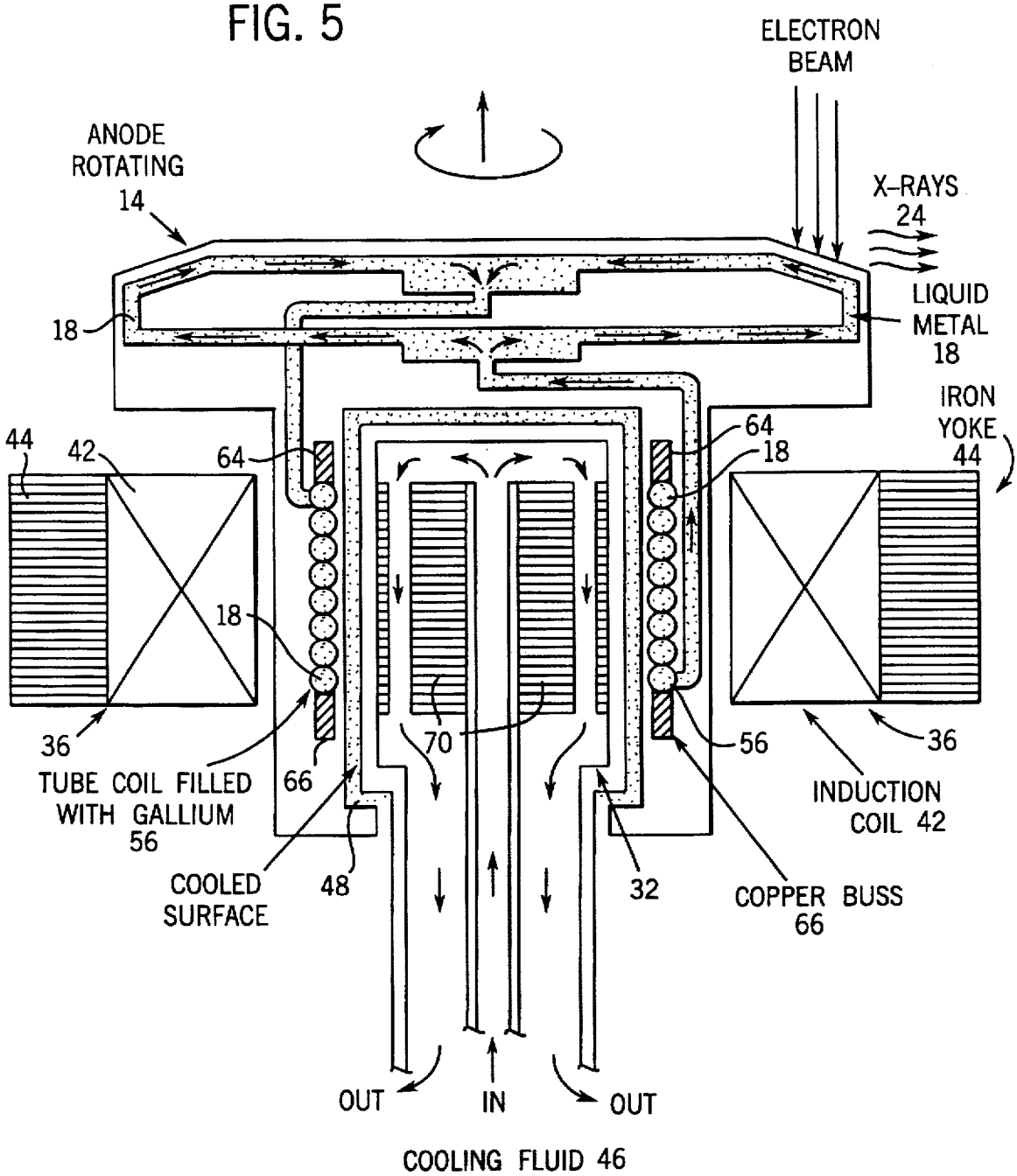
FIG. 5 illustrates a rotating anode including an induction coil for pumping liquid metal coolant.

A fourth preferred embodiment requires a structure for the rotating anode 14 which is similar to the one shown in FIG. 4, but with both the induction motor 36 at the bottom of the rotating anode 14 and the permanent magnet structure removed (see FIG. 5). The induction coil 42 and its iron yoke 44 are moved up so that they overlap the tube coil 56 filled with liquid metal 18 (preferably gallium). This structure makes use of operation principles that are similar to those used in an induction motor pump. As before, the induction coil 42 generates a rotating horizontal field that induces a current to flow up one side of the tube coil 56, through the liquid metal 18, across the top of the tube coil 56 in a copper ring 64 and down the opposite side of the tube coil 56, again through the liquid metal 18 and across the bottom of the tube coil 56 to the original side of the tube coil 56. This current interacts with the magnetic field to generate the force that moves the liquid metal 18 through the tube coil 56 and generates the pumping action. The drag of the liquid metal 18 flowing through the tube coil 56 generates the force needed to rotate the anode 14. In this way, the induction motor 36 generates both the pumping action and, through frictional engagement between the liquid metal 18 and the tube coil 56, the force needed to rotate the anode 14.

The liquid metal rotating bearing 20 conducts the heat out of the shaft of the rotor as before. The magnet iron 70 in the center of the stationary cooled structure 32 enhances the rotating magnetic field. The magnet iron is laminated to reduce losses from eddy currents. The tube coil 56 acts as both the pump and as the rotor structure of an induction motor 36. As mentioned above, the vacuum envelope needed around the rotating anode 14 is not shown.

While preferred embodiments have been illustrated and described, it should be understood that changes and modifications can be made therein without departing from the invention in its broader aspects. Various features of the invention are defined in the following claims.

What is claimed is:

1. A method of cooling a rotating anode x-ray tube, comprising the steps of:

providing an electromagnetic motor to rotate said anode;

providing cooling passages in said anode;

coupling said cooling passages to a cooling structure located adjacent said electromagnetic motor;

filling said passages and said cooling structure with a liquid metal; and supplying electrical power to said electromagnetic motor to rotate said anode and to generate a rotating magnetic field which moves the liquid metal through said cooling passages and said cooling structure, wherein friction between said cooling structure and the liquid metal causes said anode to rotate.

2. The method as defined in claim 1, wherein said cooling structure comprises a coil.

3. The method as defined in claim 1 wherein said cooling structure comprises a coil of tubing.

4. The method as defined in claim 3 wherein said coil of tubing comprises stainless steel.

5. An apparatus for cooling a rotating anode x-ray tube, comprising:

an anode coupled to an electromagnetic motor for rotation;

cooling passages provided substantially within said anode;

a cooling structure in fluid communication with said cooling passages and located adjacent said electromagnetic motor; and liquid metal disposed in said cooling passages and said cooling structure and moved through said cooling passages and cooling structure by an electromagnetic field produced by said electromagnetic motor, wherein said cooling structure comprises a coil.

6. The device as defined in claim 5, wherein said liquid metal comprises gallium.

7. The device as defined in claim 5, wherein said coil comprises stainless steel tubing.

8. A device for cooling a rotating anode x-ray tube, comprising:

an anode coupled to an electromagnetic motor for rotation, said anode being mounted for rotation with a spiral-groove bearing;

said spiral-groove bearing under rotation having a high pressure area located adjacent a center portion of grooves in said spiral-groove bearing and a low pressure area located adjacent an outer portion of said grooves;

cooling passages provided substantially within said anode and providing fluid communication between said high pressure area and said low pressure area of said spiral-groove bearing;

a cooling structure in fluid communication with said cooling passages and located adjacent said electromagnetic motor; and liquid metal disposed in said cooling passages and said cooling structure flowing from said high pressure area to said low pressure area of said spiral-groove bearing due to a pressure differential between said high pressure area and said low pressure area.

9. The device as defined in claim 8, wherein said liquid metal comprises gallium.

* * * * *

UNITED STATES PATENT AND TRADEMARK OFFICE

CERTIFICATE OF CORRECTION

PATENT NO. : 5,737,387

DATED : April 7, 1998

INVENTOR(S) : Smither

It is certified that error appears in the above-identified patent and that said Letters Patent is hereby corrected as shown below:

In Column 1, line 34, insert --metal-- after "liquid".

Signed and Sealed this

Twenty-ninth Day of September, 1998

*Attest:*

*Attesting Officer*

BRUCE LEHMAN

*Commissioner of Patents and Trademarks*